US006985120B2

(12) United States Patent
Lewry et al.

(10) Patent No.: US 6,985,120 B2
(45) Date of Patent: Jan. 10, 2006

(54) REFLECTOR ANTENNA WITH INJECTION MOLDED FEED ASSEMBLY

(75) Inventors: Matthew Lewry, Edinburgh (GB); Junaid Syed, Kirkcaldy (GB)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/627,563

(22) Filed: Jul. 25, 2003

(65) Prior Publication Data

US 2005/0017916 A1 Jan. 27, 2005

(51) Int. Cl.
*H01Q 13/00* (2006.01)

(52) U.S. Cl. ..... 343/781 CA; 343/781 P; 343/840

(58) Field of Classification Search ..... 343/781 CA, 343/781 P, 837, 840
See application file for complete search history.

(56) References Cited

U.S. PATENT DOCUMENTS 2,605,416 A * 7/1952 Foster ..... 343/781 R
4,963,878 A 10/1990 Kildal
5,959,590 A 9/1999 Sanford et al.
5,973,652 A 10/1999 Sanford et al.
6,020,859 A 2/2000 Kildal
6,107,973 A 8/2000 Knop et al.
6,137,449 A 10/2000 Kildal
6,429,826 B2 8/2002 Karlsson et al.
6,522,305 B2 2/2003 Sharman

* cited by examiner

*Primary Examiner*—Shih-Chao Chen
(74) *Attorney, Agent, or Firm*—Babcock IP, LLC

(57) ABSTRACT

A reflector antenna with a self supported feed assembly that may be formed by injection molding. A waveguide portion of the feed assembly has a dielectric cone at a distal end that supports and retains a sub reflector, for example along a periphery of the sub reflector. A conductive surface coating on an internal surface of the waveguide and a bottom surface of the sub reflector creates surfaces with RF reflective and conductive properties. The return loss of the feed assembly is reduced due to a reduction of the thickness of the material forming the dielectric cone, compared to prior dielectric block designs and a soft boundary condition produced by dielectric coating of the waveguide which aids in reducing reflections to the vertex area of the reflector.

27 Claims, 4 Drawing Sheets

REFLECTOR ANTENNA WITH INJECTION MOLDED FEED ASSEMBLY

BACKGROUND

1. Field of the Invention

This invention relates to reflector antennas. More particularly, the invention provides improvements in reflector antenna pattern control, return loss performance and manufacturing cost efficiencies via a self supported sub reflector and feed tube assembly which may be formed by injection molding.

2. Description of Related Art

Many broadcast and or communications systems require antennas with a highly directional signal reception and or transmission characteristic. Reflector antennas focus a signal received by a dish shaped reflector upon a centrally mounted receiver. Alternatively, a sub reflector mounted at the focus point of the dish directs the signal into a wave guide and there through to the receiver. Because the dish shaped reflector only focuses a signal received from a single direction upon the receiver or sub reflector, reflector antennas are highly directional. When the reflector antenna is used to transmit a signal, the signals travel in reverse, also with high directivity.

Reflector antennas with a sub reflector supported and fed by a waveguide are relatively cost efficient and allow, for example, location of the transmitter and or receiver in an easily accessible location on the back of the reflector. This configuration eliminates the need for a support structure that spans the face of the reflector, partially blocking the reflector, and signal losses associated with passing the signal through a cable routed along the support structure. A waveguide with a generally circular or elliptical cross section provides the antenna with dual polarization capability.

Electrical performance of dual polarized reflector antennas with a self supported feed are typically measured with respect to gain, cross polarization, edge illumination and return loss characteristics.

Cross polarization is a form of interference that occurs when dual signals having different polarizations are simultaneously transmitted and or received by the antenna. Either of the dual signals may propagate on or reflect from surfaces of the sub reflector and/or waveguide partially transforming into the polarization mode of the other signal, creating inter-signal interference. To minimize cross polarization, prior self supported feed reflector antennas have applied corrugations to the sub reflector and/or waveguide, for example, as described in U.S. Pat. No. 4,963,878 issued Oct. 16, 1990 to Kildal.

Edge illumination refers to side lobes of the reflector antenna radiation pattern that degrade antenna directivity. A shroud lined with energy absorbing material may be added to the antenna to reduce edge illumination. However, a shroud only blocks and or absorbs edge illumination occurring at angles that intersect with the shroud. Also, shrouds increase the overall weight, wind load, structural support and manufacturing costs of the antenna. An alternative method of reducing edge illumination is use of a "deep" reflector dish and the addition of corrugations proximate the outer radius of the sub reflector to inhibit surface propagation and or field diffraction around the outer edge of the sub reflector as described in U.S. Pat. No. 5,959,590 issued Sep. 28, 1999 to Sanford et al.

Return loss is a measure of the portion of signal that, rather than being projected forward from the reflector, is returned to the transmitter. Sources of return loss in a self supported feed include the sub reflector surfaces, impedance discontinuities in the waveguide, secondary reflection from the vertex area of main reflector and or in the attachment structure between the waveguide and the sub reflector.

In both U.S. Pat. Nos. 4,963,878 and 5,959,590, the sub reflector is attached to the waveguide by a dielectric block that positions the sub reflector at a desired orientation and distance from the end of the waveguide. The interfaces between the dielectric block, waveguide, sub reflector and any adhesives or mechanical interlocks used to secure the components together create impedance discontinuities that are significant sources of return loss.

U.S. Pat. No. 6,107,973 issued Aug. 22, 2000 to Knop et al., assigned to Andrew Corporation as is the present invention, describes a reflector antenna with a self supported feed using a profiled sub reflector and a shroud. A hollow dielectric cone coupled at the narrow end to a metal waveguide and at the wide end to a metal sub reflector orients and retains the sub reflector with respect to the end of the waveguide. The thickness of the cone sidewall dielectric material, thin in comparison to the dielectric blocks of the prior patents described above, is selected to create a phase canceling effect between the signal passing through the material and the signal reflected by the dielectric material. The features of the sub reflector, waveguide, hollow dielectric cone and the precision threaded mating surfaces between each of them are relatively complex and therefore expensive to manufacture. A plurality of seals are used between each of the separate components comprising the feed assembly, each representing a possible moisture penetration point should the seal(s) fail over time. Also, an additional hub component is required to mount the self supported feed to the reflector Competition within the reflector antenna industry has focused attention on antenna designs that reduce antenna materials and manufacturing costs but which still satisfy and or improve upon stringent electrical specifications, Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
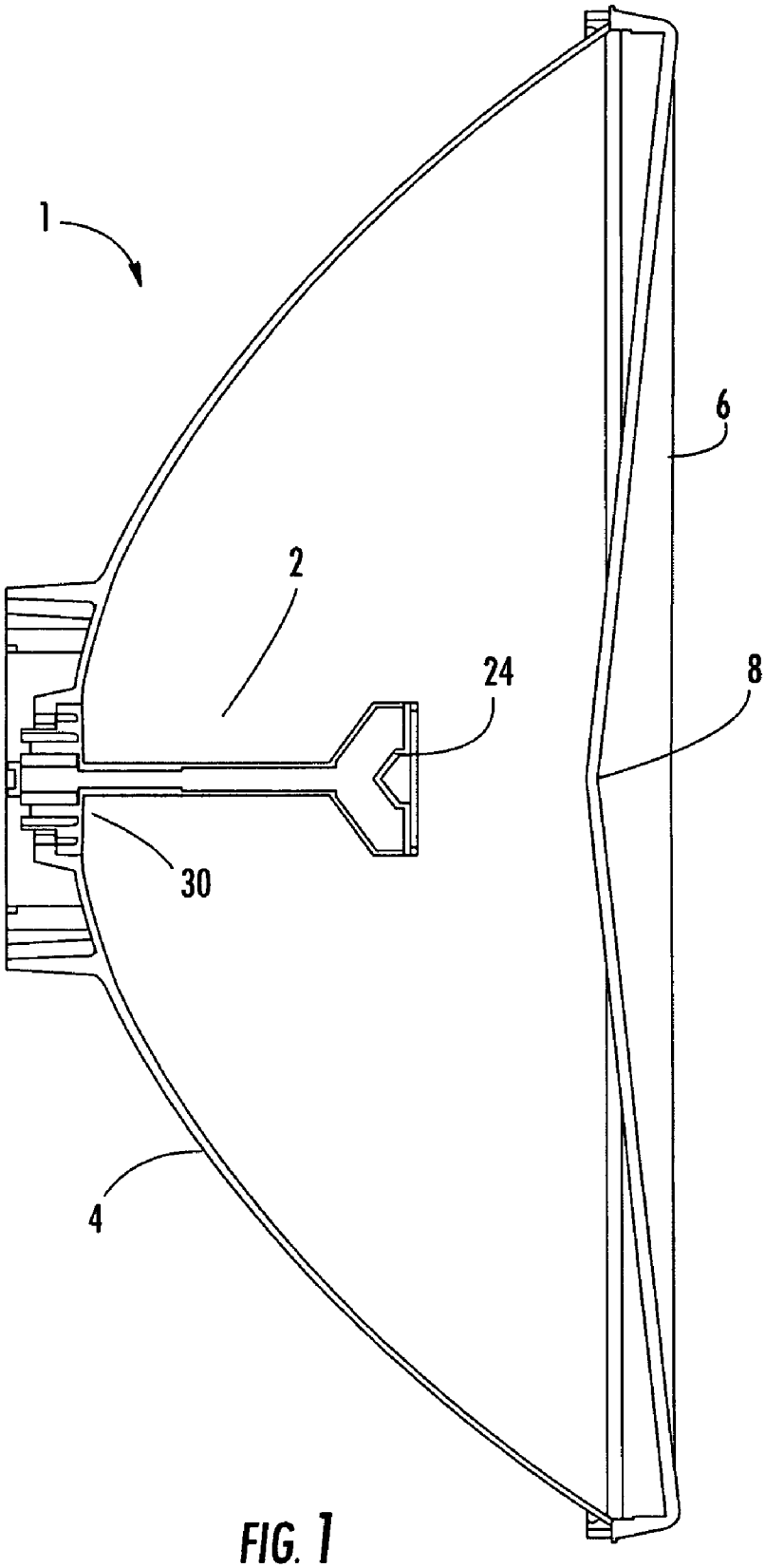
FIG. 1 is a side section view of a reflector antenna with a self supported feed according to a first embodiment of the invention.

A first embodiment of a reflector antenna 1 according to the invention is shown in FIG. 1. The feed assembly 2 is mounted at the center of a reflector 4. The reflector 4 is a so-called "deep" reflector with a generally parabolic shape that has been phase corrected. The reflector 4 may be formed from, for example, metal or plastic with an RF reflective coating. A cover 6 formed from dielectric material may also be added to inhibit environmental fouling and or improve wind loading characteristics of the antenna. The cover 6 may be strengthened by a center indentation 8. Also, the inclined dielectric surfaces with respect to the signal direction created by the center indentation 8 of the cover allows energy to pass through with minimum degradation in the return loss performance of the antenna. As shown, the reflector antenna 1 of FIG. 1 is 600 mm in diameter. One skilled in the art will appreciate that the reflector antenna 1 may be configured for smaller or larger diameters as desired.

Figure 2:
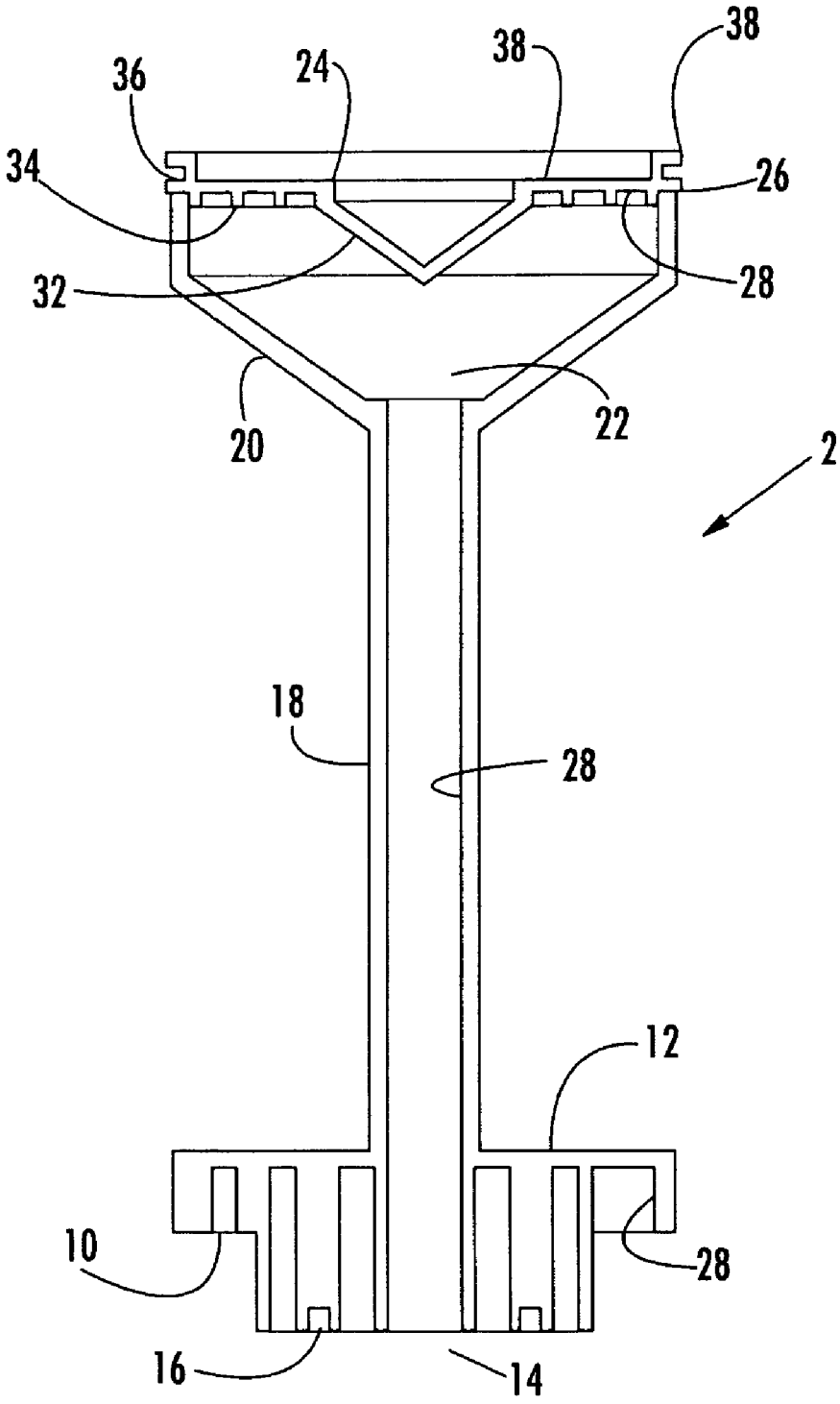
FIG. 2 is a side cross sectional view of the self supported feed shown in FIG. 1.
Figure 3:
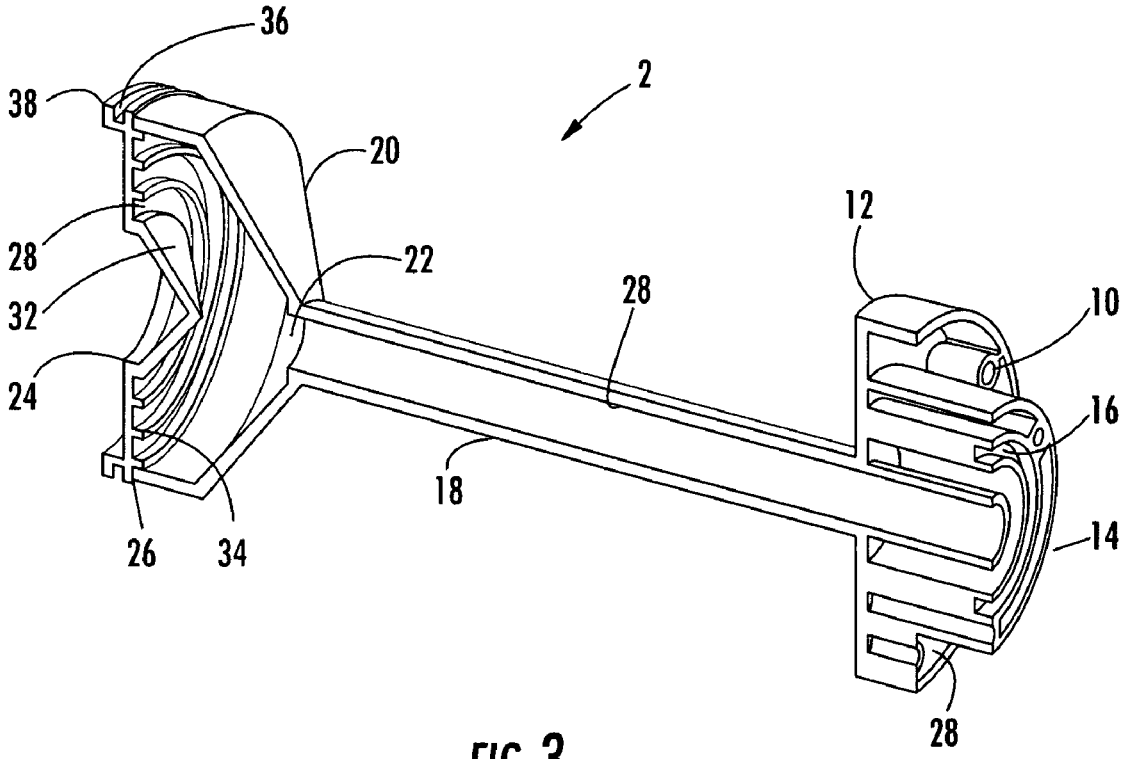
FIG. 3 is an isometric cross sectional side view of the self supported feed shown in FIG. 1.

One embodiment of the feed assembly 2 is shown greater detail in FIGS. 2 and 3. The feed assembly 2 may be mated to the reflector 4 by a plurality of screws (not shown) that attach to screw hole(s) 10 formed in a hub 12 on the proximal end 14. Additional screws may be used to compress an o-ring (not shown) located in an o-ring groove 16 between the hub 12 and an electronics module (not shown) to environmentally seal the RF signal path through the feed assembly 2.

A waveguide 18 extends through the hub 12. If the waveguide 18 has a circular or elliptical cross section, the reflector antenna 1 will have simultaneous dual polarized signal capability. The waveguide 18 has a dielectric cone 20 formed at a distal end 22 adapted to extend from the diameter of the waveguide 18 to, for example, the diameter of a sub reflector 24. The sub reflector 24 is connected to and supported by the dielectric cone 20 along, for example, a periphery 26 of the sub reflector 24.

The waveguide 18, dielectric cone 20, sub reflector 24 and hub 12 may be formed using injection molding technologies. The bottom of the hub 12 may be formed with a plurality of ridges and or ribs to strengthen the hub 12 while minimizing the overall amount of raw molding material required. Injection molding of each of the components may be simplified if the surfaces which the molds separate from are designed with a draft of at least 0.5 degrees and corners with a radius of at least 0.2 mm. As may be seen in FIG. 2, applying the 0.5 degrees taper to the waveguide with the proximal end 14 being the narrow end allows the waveguide 18 and the dielectric cone 20 to be injection molded as a single, integral part. Alternatively, the components may also be formed using other plastic forming technologies such as machining or laser cured resin.

The waveguide 18 and dielectric cone 20 component may then be mated to the hub 12 by ultrasonic welding to create a single precision molded component. Further, the sub reflector 24 may be ultrasonically welded to the distal end of the dielectric cone 20, entirely sealing the distal end of the feed assembly. Ultrasonic welding of the sub components of the feed assembly 2 provides cost effective permanent seamless leak proof "welded" connections of higher quality than is obtainable using other methods such as adhesives which can create significant impedance discontinuities between the joined surfaces.

The plastic resins commonly used for injection molding, for example ultem and polystyrene, are generally dielectric. Therefore, a surface coating 28 is used to give the waveguide 18, sub reflector 24 and hub 12 components of the feed assembly 2 electrically conductive and RF reflective surfaces. The surface coating 28 may be, for example, one or more layers of conductive metal and or metal alloy, for example copper, silver, gold or other conductive material. The surface coating 28 is preferably applied to the interior surface of the waveguide 18, the proximal end 14 of the hub and at least the bottom surfaces of the sub reflector 24.

The sub reflector 24 has a conical reflecting surface 32 adapted to, depending upon whether the antenna 1 is being used in a transmission or reception mode, spread and or collect RF signals either from the waveguide 18 to the reflector 4 or from the reflector 4 into the waveguide 18. A plurality of corrugations 34 may be formed, for example as part of the injection molding pattern, between the periphery 26 of the sub reflector 24 and the conical reflecting surface 32 to inhibit cross polarization and edge illumination of the RF signals.

One or more radial choke(s) 36 may be added to the side edge 38 of the sub reflector 24 to further reduce direct radiation of the feed into the far-field secondary patterns. If an injection molded sub reflector 24 is used, the choke(s) 36 may be cut into the sub reflector 24 after injection molding or a metal or metalized plastic plate with one or more radial choke(s) 36 therein may be attached to the back side 38 of the sub reflector 24.

The combination of the "deep" phase corrected reflector 4 with a sub reflector 24 having peripheral corrugations 34 and radial chokes 36 results in a reflector antenna 1 that does not require addition of a shroud to achieve a radiation pattern with reduced edge illumination.

The size and angle of the dielectric cone 20 is configured to position the sub reflector 24 at a distance from and orientation with respect to the distal end 22 of the waveguide 18 that allows signals to reflect off of the conical reflecting surface 32 without interference from the distal end 22 of the waveguide 18. Surface features and thickness of the dielectric material that forms the dielectric cone 20 as well as the angle of the dielectric cone 20, may be further tuned to adapt the RF characteristics as desired for minimum illumination of the reflector 4 vertex area 30 and thereby reduced return loss. As shown in FIGS. 2 and 3, the cone 20, formed in this example from ultem, has an angle of 42 degrees from the feed axis and a thickness of 2.6 mm.

Specific dimensions of the feed design may be developed using iterative numerical optimization. A general set of feed dimensions is selected as a starting point for a desired radiation pattern, cross-polar and return loss performance. For example, the diameter of the sub reflector 24 is between $3\lambda o$ and $4\lambda o$. Also, the depth of the corrugations 34 is approximately $0.3\lambda o$, the gaps between the radiating end of the waveguide 18 and the vertex of conical reflecting surface 32 and the edge of the corrugations 34 are $0.2\lambda o$ and $0.75\lambda o$ respectively. The inner diameter of the waveguide 18 varies along the length of the waveguide 18 to simplify manufacture by injection molding and is configured to be approximately $1\lambda o$. Also, the inner diameter of the waveguide 18 may be varied if only TE11 mode is desired. The feed dimensions are then optimized numerically to arrive at a best fit for the desired overall feed performance.

The corrugations 34 on the sub reflector 24 generate a soft boundary condition, which suppresses surface waves along it. The soft boundary condition may be used to control the edge illumination of the reflector 4 and cross-polar performance of the feed. However, reflections due to the corrugations 34 create significant radiation in the front hemisphere including along the waveguide 18. The radiation along waveguide 18 degrades the return loss performance of the reflector antenna 1 due to intense secondary reflection from the vertex area 30 of the reflector 4. The return loss degradation due to secondary reflections from the vertex area 30 of the reflector 4 may be reduced using vertexing on the reflector and or by suppressing the energy along the waveguide 18 i.e. generating an M-type feed-radiation pattern by creating a soft boundary condition along the outer surface of the waveguide 18.

The injection molding and application of an inner surface conductive surface coating 28 to create the waveguide 18 results in a waveguide 18 with an inherent soft boundary condition. The soft boundary condition may be adjusted by varying the thickness of the dielectric over the injection-molded waveguide 18 to suppress the surface waves. As a starting point, the critical thickness of the dielectric is computed using $\lambda_o/4\sqrt{\epsilon_r-1}$, which is then optimized along with other feed dimensions to arrive at the target feed performance.

Figure 4:
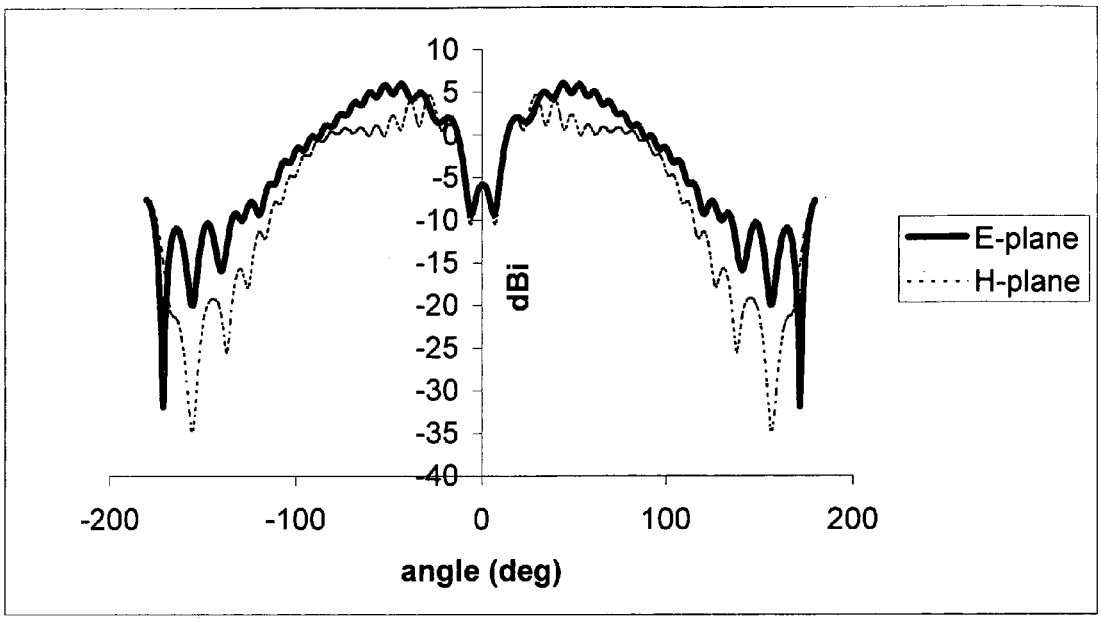
FIG. 4 is a radiation pattern at 22.4 Ghz for a feed assembly according to the first embodiment of the invention.

A chart of the M-type radiation pattern between amplitude (dBi) and angle from the feed axis (degrees) of the feed assembly 2 generated using commercially available RF modeling software using the FDTD method is shown in FIG. 4. The soft boundary condition at the end and along the outer surface of the waveguide 18 operates to reduce reflections to and from the vertex area 30 of the reflector 4 without requiring addition of components to the waveguide 18 or extra manufacturing steps such as forming corrugations in or adding RF absorbing material to outer surfaces of the waveguide 18.

Figure 5:
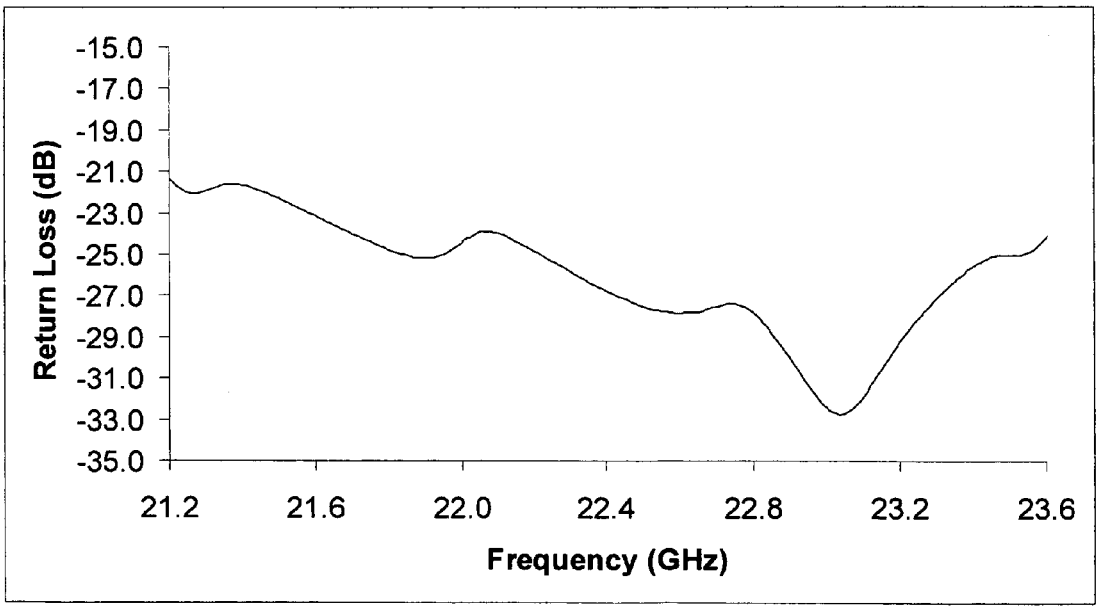
FIG. 5 is a return loss graph between 21.2 and 23.6 Ghz for a feed assembly according to the first embodiment of the invention.

In addition to the sub reflector 24 configuration and soft boundary condition created by the dielectric outer surface of the waveguide 18, because the RF signal path through the dielectric material of the dielectric cone 20 is greatly reduced, compared to the prior dielectric block designs, the impedance discontinuity caused by the dielectric cone 20 is reduced resulting in significant reductions in the return loss for the reflector antenna 1 overall. As shown by the chart in FIG. 5, generated using the RF modeling software described herein above, the feed assembly 2 has a better than 21 dB return loss between 21.2 and 23.6 Ghz.

From the foregoing, it will be apparent that the present invention brings to the art a reflector antenna 1 with improved electrical performance and significant manufacturing cost efficiencies. The feed assembly 2 of a reflector antenna 1 according to the invention is a strong, lightweight and environmentally sealed component that may be repeatedly cost efficiently manufactured with a very high level of precision.

Table of Parts

| | |
|---|---|
| 1 | antenna |
| 2 | feed assembly |
| 4 | reflector |
| 6 | cover |
| 8 | center indentation |
| 10 | screw hole |
| 12 | hub |
| 14 | proximal end |
| 16 | o-ring groove |
| 18 | waveguide |
| 20 | dielectric cone |
| 22 | distal end |
| 24 | sub reflector |
| 26 | periphery |
| 28 | surface coating |
| 30 | vertex area |
| 32 | conical reflecting surface |
| 34 | corrugations |
| 36 | radial choke |
| 38 | back side |

Where in the foregoing description reference has been made to ratios, integers, components or modules having known equivalents then such equivalents are herein incorporated as if individually set forth.

Each of the patents identified in this specification are herein incorporated by reference in their entirety to the same extent as if each individual patent was fully set forth herein for all each discloses or if specifically and individually indicated to be incorporated by reference.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A reflector antenna, comprising:

a reflector; and a feed assembly centrally mounted on the reflector;

the feed assembly having a hub from which a waveguide extends; a distal end of the waveguide flaring into a dielectric cone which couples with a sub reflector at a periphery of the sub reflector.

2. The antenna of claim 1, wherein the hub, the waveguide and the sub reflector are ultrasonically welded into a single integral component.

3. The antenna of claim 1, wherein an internal surface of the waveguide, except the dielectric cone, and a bottom surface of the sub reflector are coated with a conductive material.

4. The antenna of claim 3, wherein the conductive material is one of copper, silver and gold.

5. The antenna of claim 3, wherein the waveguide exhibits a soft boundary characteristic adjacent the surface coating.

6. The antenna of claim 1, further including a radial choke formed in a side edge of the sub reflector.

7. The antenna of claim 6, wherein the radial choke is formed in a plate coupled to the sub reflector.

8. The antenna of claim 1, wherein the sub reflector has a conical reflecting surface projecting towards the distal end of the waveguide and a plurality of corrugations between an outside edge of the conical reflecting surface and the periphery of the sub reflector.

9. A feed assembly for a reflector antenna, comprising:

a waveguide coupled at a proximal end to a hub;

the waveguide flaring into a dielectric cone at a distal end;

the cone extending from a waveguide diameter to a sub reflector diameter; and a sub reflector coupled to the cone along a periphery of the sub reflector.

10. The apparatus of claim 9, wherein the waveguide is ultrasonically welded to the hub and the sub reflector is ultrasonically welded to the dielectric cone.

11. The apparatus of claim 9, wherein the interior surface of the waveguide, except the dielectric cone, and a bottom surface of the sub reflector is surface coated with a conductive material.

12. The apparatus of claim 11, wherein the conductive material is one of copper, silver and gold.

13. The apparatus of claim 9, wherein the sub reflector has a conical reflecting surface projecting towards the distal end of the waveguide and a plurality of corrugations between the conical reflecting surface and the periphery of the sub reflector.

14. The apparatus of claim 13, further including a radial choke formed in a side edge of the sub reflector.

15. A method for manufacturing a feed assembly for a reflector antenna, comprising the steps of:

injection molding a waveguide having a dielectric cone at a distal end;

injection molding a sub reflector;

coating an interior surface of the waveguide, except the dielectric cone, and a bottom surface of the sub reflector with a conductive material; and ultrasonically welding the sub reflector to a distal end of the dielectric cone.

16. The method of claim 15, further including the steps of injection molding a hub; and ultrasonically welding a proximal end of the waveguide to the hub.

17. The method of claim 15, further including the step of coating a bottom surface of the hub with a conductive material.

18. The method of claim 15, further including the step of forming a radial choke in a periphery of the sub reflector.

19. The method of claim 18, wherein the radial choke is formed in a plate which is coupled to a top side of the sub reflector.

20. A feed assembly for a reflector antenna, comprising:

a waveguide with a proximal end and a distal end, the waveguide formed out of a dielectric material coated with a conductive material on an internal surface;

a dielectric cone extending from a waveguide radius at the distal end of the waveguide to a larger sub reflector radius; and a sub reflector coupled to the sub reflector radius of the dielectric cone.

21. The assembly of claim 20, further including a conical reflecting surface on the sub reflector projecting towards the distal end, the conical reflecting surface surrounded by a plurality of corrugations.

22. The assembly of claim 20, further including a hub coupled to the proximal end of the waveguide.

23. The assembly of claim 20, further including a radial choke formed along a side edge of the sub reflector.

24. The assembly of claim 20, further including a plate having a side edge with a radial choke; the plate coupled to a top side of the sub reflector.

25. The assembly of claim 20, wherein the waveguide and the cone are formed as a contiguous piece of dielectric material.

26. The assembly of claim 20, wherein the sub reflector is formed out of a dielectric material coated on a bottom surface with a conductive material.

27. The assembly of claim 20 wherein the sub reflector is attached to the sub reflector radius along a periphery of the sub reflector.

* * * * *